US006910538B2

(12) United States Patent
Tinker

(10) Patent No.: US 6,910,538 B2
(45) Date of Patent: Jun. 28, 2005

(54) WHIPSTOCK COLLET LATCH

(75) Inventor: Donald W. Tinker, Rapid City, MI (US)

(73) Assignee: Team Oil Tools, Tulsa, OK (US)

( * ) Notice: Subject to any disclaimer, the term of this patent is extended or adjusted under 35 U.S.C. 154(b) by 0 days.

(21) Appl. No.: 10/345,229

(22) Filed: Jan. 16, 2003

(65) Prior Publication Data

US 2003/0213599 A1 Nov. 20, 2003

Related U.S. Application Data

(60) Provisional application No. 60/381,352, filed on May 20, 2002.

(51) Int. Cl.[7] ..... E21B 23/03; E21B 23/12

(52) U.S. Cl. ..... 166/380; 166/117.5; 166/117.6

(58) Field of Search ..... 166/380, 117.5, 166/117.6, 55.1

(56) References Cited

U.S. PATENT DOCUMENTS 2,982,125 A * 5/1961 Gilreath ..... 166/381
4,182,423 A * 1/1980 Ziebarth et al. ..... 175/61
4,444,254 A * 4/1984 Rathburn ..... 166/216
5,123,489 A * 6/1992 Davis et al. ..... 166/377
5,467,819 A * 11/1995 Braddick ..... 166/117.6
5,595,247 A * 1/1997 Braddick ..... 166/297
5,771,972 A * 6/1998 Dewey et al. ..... 166/298
5,787,978 A * 8/1998 Carter et al. ..... 166/117.6
5,826,651 A * 10/1998 Lee et al. ..... 166/117.6
5,894,889 A * 4/1999 Dewey et al. ..... 166/298
5,960,882 A * 10/1999 Polivka ..... 166/297
6,102,123 A * 8/2000 Bailey et al. ..... 166/313
6,302,198 B1 * 10/2001 Ritorto et al. ..... 166/55.1
6,315,044 B1 * 11/2001 Tinker ..... 166/298
2002/0170713 A1 * 11/2002 Haugen et al. ..... 166/298

* cited by examiner

*Primary Examiner*—David Bagnell
*Assistant Examiner*—Shane Bomar
(74) *Attorney, Agent, or Firm*—Merek, Blackmon & Voorhees, LLC

(57) ABSTRACT

A method of anchoring a whipstock on the mill or drill body using an anchor extendible to engage an eyelet formed or provided on the whipstock to run in a mill and whipstock in one trip. The anchor is retractable into the body of the drill so that the drill can pass by the whipstock during lateral drilling and out the casing wall without interference. The anchor preferably is extended and retracted by hydraulic force controlled remotely by the operator. The anchor is preferably shaped to match and conform to the outer wall of the drill so that in the closed position, the anchor is contiguous with and does not extend beyond the outer diameter of the drill body. Part of the drill body is preferably removed to allow the anchor to nest within the space provided by the removal of the drill body.

14 Claims, 4 Drawing Sheets

WHIPSTOCK COLLET LATCH

This application claims the benefit of Provisional Application No. 60/381,352, filed May 20, 2002.

BACKGROUND OF THE INVENTION

A. Field of the Invention

The present invention relates to a collet latch for attaching a drill to a whipstock during run in to reduce the number of trips necessary to slant drill a well bore.

B. Description of the Prior Art

The use of a whipstock to slant drill through the side of a well bore at an angle is well known. See for instance U.S. Pat. No. 6,315,044 to Tinker issued Nov. 13, 2001, which is incorporated herein by reference, showing a method of locating and orienting a whipstock. Part of the wall of the casing in which the whipstock is located has been pre-milled to facilitate lateral drilling outside of the main well bore. The whipstock is oriented to direct the drill through the pre-milled "window" in the casing to the area surrounding the well bore where it is desired to drill. As the drill is lowered into the well bore, the angled ("concave") face of the whipstock redirects the drill bit away from the vertical position into contact with the casing surrounding the drill allowing lateral drilling to take place.

Previously, as shown in U.S. Pat. No. 6,315,044, the whipstock was run into place during a first run and after removing the entire drill string above the whipstock, the drill was run ("tripped") into the hole to initiate drilling. This inefficiency of using two trips to install the whipstock and to then insert the drill leads to increased expenses and tooling. It is desirable to run both the drill and the whipstock into the well bore in one trip to save time, equipment and the costs associated therewith.

The present invention teaches a new apparatus and method for installing the whipstock and drill simultaneously by a unique arrangement for attaching the whipstock to the drill for concurrent installation.

None of the above inventions and patents, taken either singly or in combination, is seen to describe the instant invention as claimed.

SUMMARY OF THE INVENTION

The present invention is accomplished by providing an anchor on the drill body which is extendible to engage an eyelet formed or provided on the whipstock. The anchor is retractable into the body of the drill so that the drill can pass by the whipstock during lateral drilling and out the casing wall without interference. The anchor preferably is extended and retracted by hydraulic force controlled remotely by the operator. The anchor is preferably shaped to match and conform to the outer wall of the drill so that in the closed position, the anchor is contiguous with and does not extend beyond the outer diameter of the drill body. Part of the drill body is preferably removed to allow the anchor to nest within the space provided by the removal of the drill body.

Accordingly, it is a principal object of the invention to provide an arrangement for securing the whipstock to the drill for inserting the whipstock.

It is another object of the invention to provide a hydraulic activation tool for selectively extending and retracting an anchor on the body of the drill which cooperates with an eyelet on the whipstock to selective join the whipstock to the drill body.

Still another object of the invention is to provide a hydraulically retractable anchor on a drill body which withdraws the anchor to prevent any interference between the anchor and the casing or whipstock.

It is a further object of the invention to a mechanically set whipstock which is selectively attachable to a drill for running into a well bore.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings. The present invention

DETAILED DESCRIPTION OF THE PREFERRED EMBODIMENT(S)

The present invention relates to a new method and arrangement for a single trip run in of the whipstock and drill using a hydraulically activated latch on the drill body.

Figure 1:
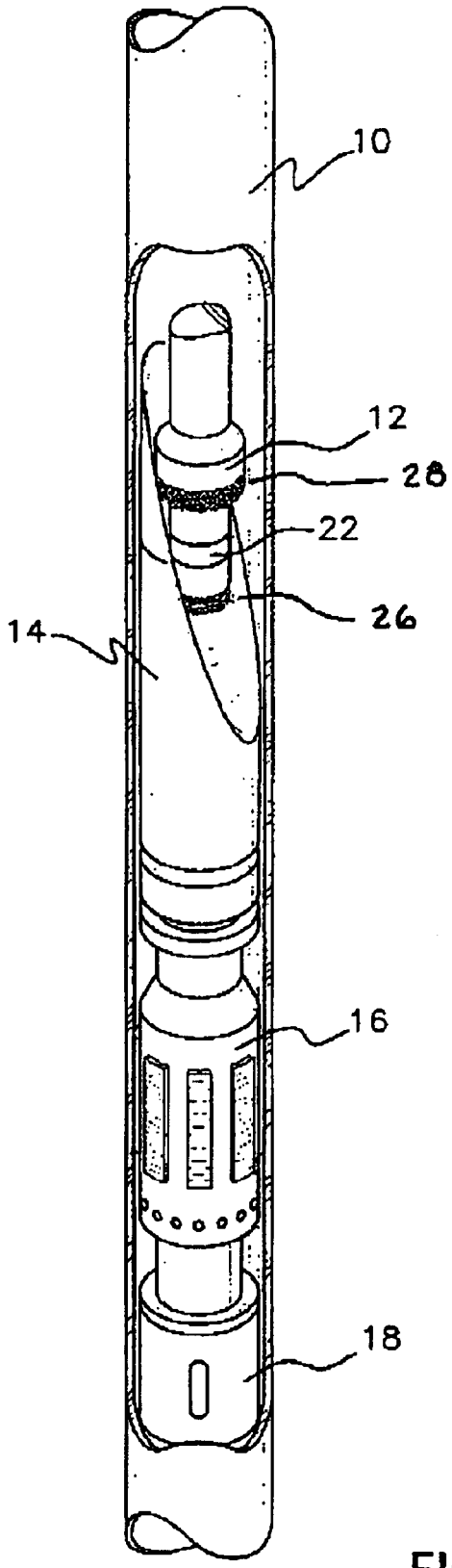
FIG. 1 is an environmental perspective view of the invention shown mounted in a well casing.

FIG. 1 shows a well bore casing 10 installed in a well (not shown). The drill 12 is shown attached to a whipstock 14. Though not necessary for the current invention, the whipstock is shown in a typical configuration with a packer body 16 and orientation sub 18 for locating and orienting the whipstock in the proper position as is known in the art and shown in U.S. Pat. No. 6,315,044, which is hereby incorporated by reference.

In operation, the whipstock is lowered in the wellbore to the desired location pointing the slanted surface of the whipstock such that it will direct the drill to a point in the casing where lateral drilling is to be performed. In prior devices, the whipstock is run in separately from the drill and is oriented into position. The drill is then run in during a second trip and as the drill contacts the whipstock face, the drill is redirected outwardly into or through the casing into the surrounding earth where lateral drill occurs outwardly from the bore.

The present invention teaches a method of running the drill and the whipstock in in one trip, thus saving time, manpower, equipment and thus money. By releasably connecting the whipstock to the drill, the drill can be used to run the whipstock into the bore whereupon the whipstock can be separated from the drill and operated in the normal fashion.

Figure 4:
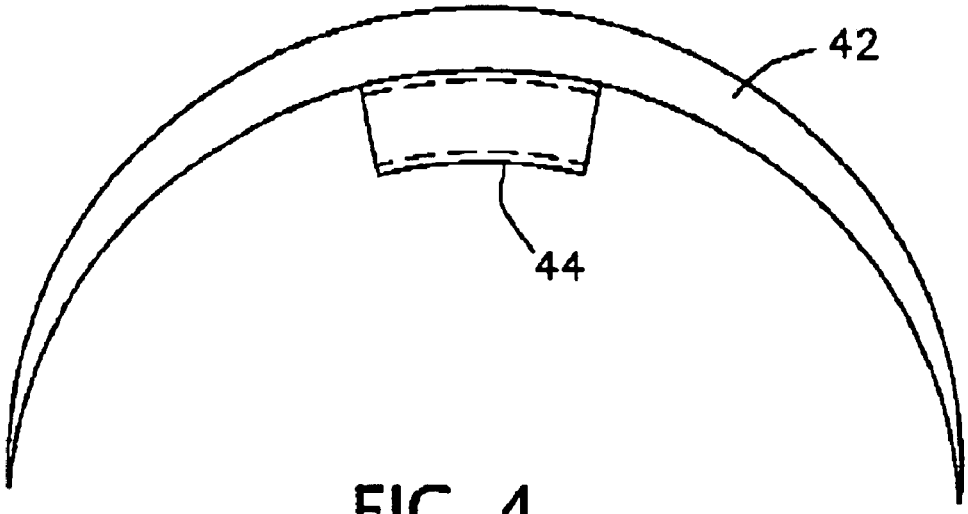
FIG. 4 is partial top plan view of whipstock having an eyelet for receiving an anchor according to the present invention.

FIG. 1 shows the whipstock connected to the drill during run in. As seen in FIG. 4, the whipstock has a curved face 42. The face slants from a top point to a wide base as shown in FIG. 1. This allows the round drill to ride within the whipstock face to redirect the cutting or abrading element ("face") of the drill from the vertical run in position to an outwardly facing position to cut through or outwardly away from the bore wall in a lateral direction once the drill is separated from the whipstock.

Figure 2A:
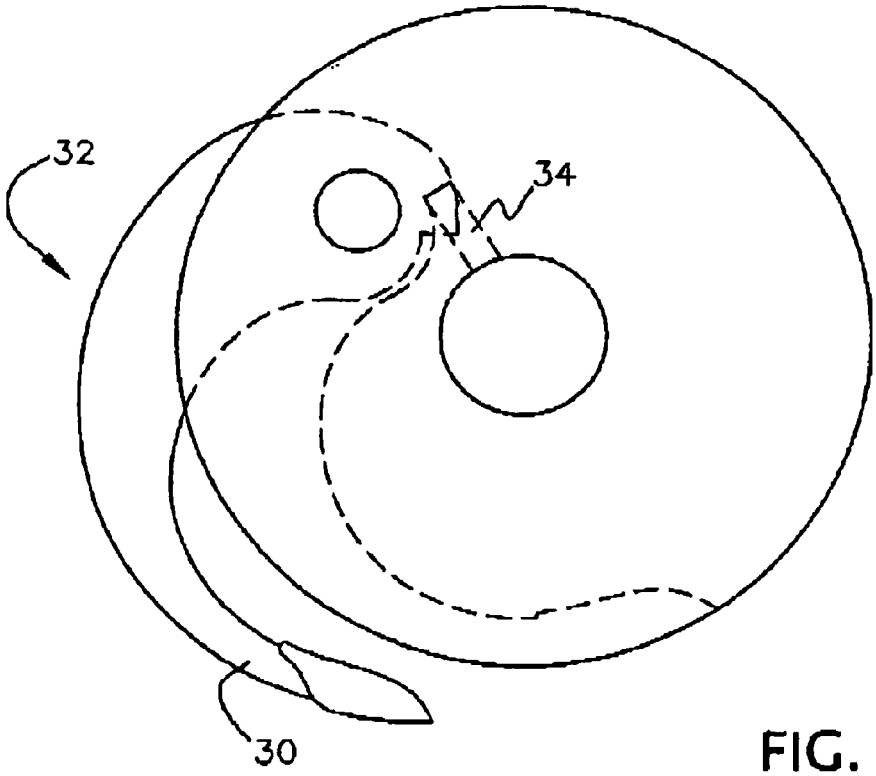
FIG. 2A is a top plan view of the anchor of the present invention shown in an extended position.
Figure 2B:
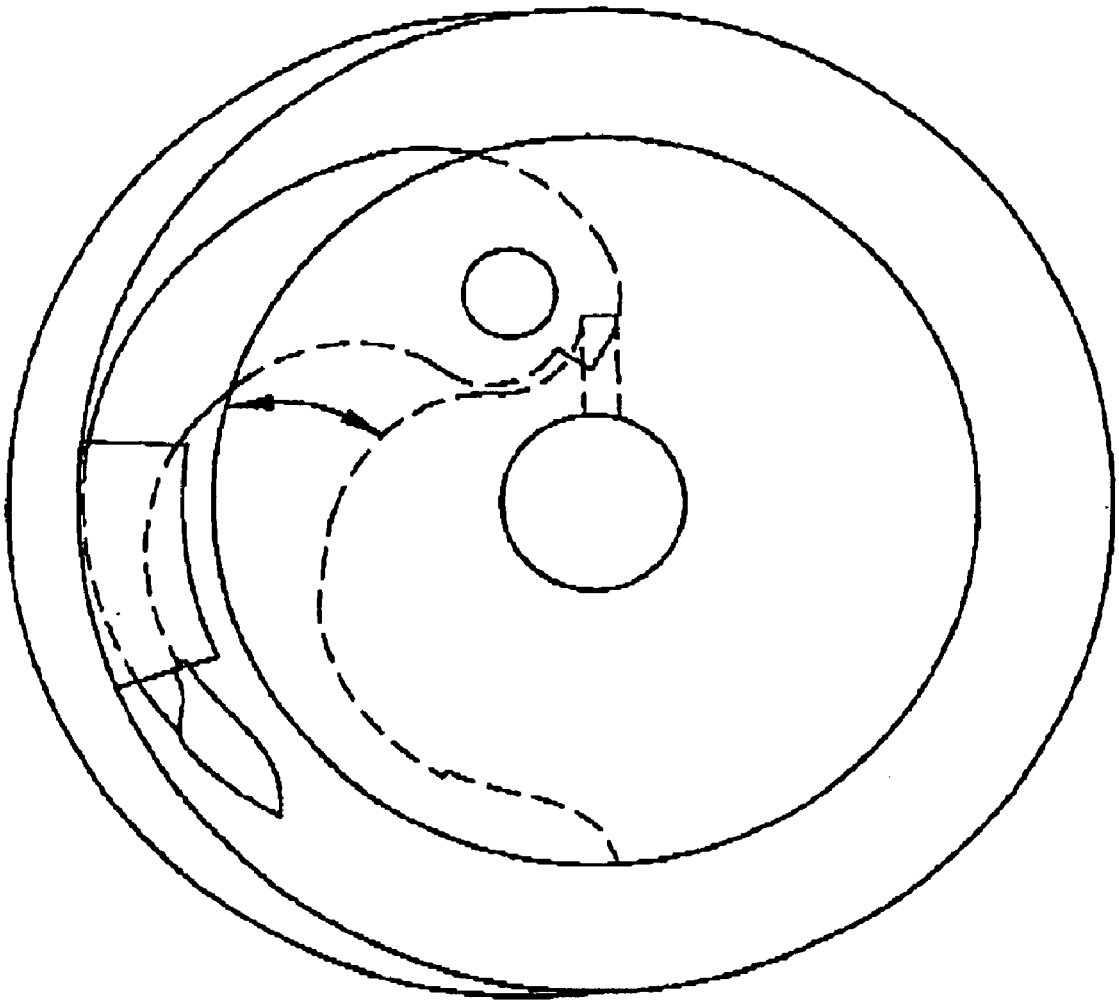
FIG. 2B is a top plan view of the anchor locked into the eyelet of the whipstock for run in according to the present invention.
Figure 5:
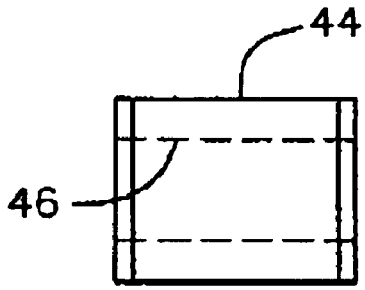
FIG. 5 is a front elevational view of an eyelet according to the present invention for mounting onto a whipstock.

As shown in FIGS. 2B, 4 and 5, in order to connect the drill and the whipstock during run in, a sleeve 44 is provided near the middle of the whipstock face, although the location on the face where the sleeve is connected can easily be closer or farther from the base. However, in the preferred embodiment, the sleeve is near the midpoint to connect to a hydraulic latch finger 30 located at on the body 22 of the drill ("window mill") 12 intermediate the two drill cutting faces. In the extended position as shown in FIGS. 2A and 2B, the finger 30 of the clamp can be inserted through the sleeve 44 to lock the drill and the whipstock together.

Figure 3:
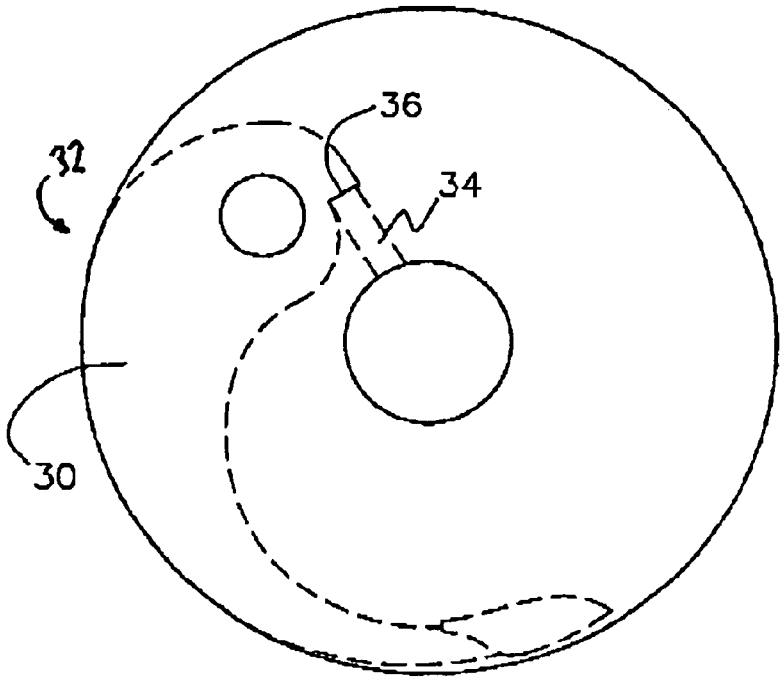
FIG. 3 is a top plan view of the anchor in the retracted position.

The hydraulic latch 32 has a reservoir 34 connected to or controllable by an actuator (not shown) which by means well known in the art, increases or decreases the pressure in the reservoir 34. This actuator may be by a pump, a piston, or other device. One skilled in the art would also recognize that the actuator could be a simple mechanical device such as a spring, but is less preferable because of there is less control over when the operation of a spring as compared to a hydraulic actuator. The actuator may be contained within the drill 12, along the string 24 connecting the drill to the surface, or may be at the surface. The actuator is selectively controlled by an operator (not shown) who activates the actuator to increase or decrease the pressure level in the reservoir 34. According to the preferred embodiment of the invention, when the pressure of the fluid in the reservoir is increased, the fluid acts against the shoulder 36 to move the shoulder away from the center of the drill body, thus closing the hydraulic latch 32. When the latch is fully closed, the outer periphery of the finger is preferably contiguous with the outer wall of the drill body to provide a smooth cylindrical drill body when in the closed position as shown in FIG. 3. This will allow the drill body to smoothly ride within the whipstock face as the drill is deployed as will further herein be explained.

When the pressure in the reservoir is released, the finger is allowed to open. However, in the preferred embodiment, it is not necessary that the latch 32 "opens" when the pressure is released, as the latch need only be closed during operation. The latch can be manually "opened" while at the surface when the whipstock is connected to the drill body. However, the latch may be assisted in opening by a spring or strictly by a negative pressure on the shoulder 36 caused by the withdrawal of hydraulic pressure from reservoir 34.

In operation, the pressure of the reservoir 34 is reduced to allow the latch 32 to open. With the finger 32 of the hydraulic latch 36 in the extended position, the finger is manually threaded through and engaged with the sleeve of the whipstock to secure the whipstock to the drill body for run in. It may be necessary to slightly close the latch 32 by raising the pressure of the reservoir 34 to ensure that the sleeve 44 of the whipstock is clamped within the latch 32.

With the whipstock and the drill body thus engaged and connected, the drill and the whipstock are lowered from the surface into the casing 10 of the wellbore. When the whipstock is positioned in the desired location by use of an orientation sub 18 or other device, the drill body may be disengaged from the whipstock.

To disengage the drill body from the whipstock, the pressure in the reservoir may be released to ensure that the finger 30 of the latch can move freely, but in most circumstances this precaution is unnecessary. The drill body is then rotated relative to the drill body to rotate and unthread the finger from the sleeve 44. When the drill body has been rotated sufficiently to disengage the finger 30 of the hydraulic latch 32 from the whipstock sleeve 44, pressure is added to the reservoir 34 to close the latch 32.

With the body 22 of the drill 12 restored to it smooth cylindrical exterior, the drill can be lowered relative to the whipstock 14. As the drill (or mill) is lowered the drill rides in the curved channel formed by whipstock face, moving the bottom of the drill from a downward facing position to an outwardly facing position. The bottom cutting edge 26 will then engage and cut the casing, or if the casing has already been removed as a window, the mill will contact the earth surrounding the casing cutting a lateral path through the earth. The larger cutting face 28 will follow the bottom lower face 26 boring a wider hole through the earth.

One skilled in the art would recognize that the process could be reversed to reengage the whipstock sleeve to withdraw the whipstock from the well, but this would normally be impractical to realign the sleeve 44 and the latch finger 30. However, it may be necessary immediately after removing the finger from the sleeve to reinsert the finger into the sleeve should some unforeseen event occur. In this case, the procedure described above would be reversed to reinsert the finger 30 into the sleeve 44.

One skilled in the art would also appreciate that instead of unthreading the latch finger 30 from the sleeve 44, that the sleeve could be provided with perforations 46 (FIG. 5) or otherwise frangible such that just by closing the latch 32, the finger 30 would tear through the wall of the sleeve 44 to release the drill body from the whipstock 14 without departing from the scope of the invention. However, this would require replacement of the sleeve during each run in and is thus less preferable.

It is to be understood that the present invention is not limited to the sole embodiment described above, but encompasses any and all embodiments within the scope of the following claims.

I claim:

1. A mill for running into a well bore comprising:

a substantially cylindrical mill body and at least one cutting or abrading element attached to said cylindrical mill body;

said cylindrical mill body having a recess defined therein for receiving a latch;

said latch received within said cylindrical body recess and movably attached to said cylindrical body between an open position and a closed position; and an actuator for closing said latch against said cylindrical body to a closed position.

2. The mill of claim 1, further comprising:

an actuator for closing said latch radially inwardly against said cylindrical body to said closed position.

3. The mill of claim 1, further wherein said latch outer surface has substantially the same curvature as the substantially cylindrical mill body, such that when said latch is in said closed position, said substantially cylindrical mill body and said latch cooperate to form a cylindrical mill body surface.

4. The mill of claim 1, further wherein said actuator is controlled by a controller remote from said mill.

5. The mill of claim 1, further wherein said actuator is controlled by a controller on said surface of said well bore.

6. A mill for running a whipstock into a well bore comprising:

a substantially cylindrical mill body and at least one cutting or abrading element attached to said cylindrical mill body;

said cylindrical mill body having a recess defined therein for receiving a latch;

said latch received within said cylindrical body recess and movably attached to said cylindrical body between an open position and a closed position;

a whipstock having a top and a bottom and an angled face;

said whipstock further having a sleeve mounted along said angled face for receiving said latch;

wherein when said latch is inserted into said whipstock sleeve, said whipstock can be run into the wellbore attached to said mill; and an actuator for closing said latch against said cylindrical body to said closed position.

7. The mill of claim 6, further comprising:

wherein said actuator closes said latch radially inwardly against said cylindrical body to said closed position.

8. The mill of claim 6, further wherein said latch outer surface has substantially the same curvature as the substantially cylindrical mill body, such that when said latch is in said closed position, said substantially cylindrical mill body and said latch cooperate to form a cylindrical mill body surface.

9. The mill of claim 6, further wherein said actuator is controlled by a controller remote from said mill.

10. The mill of claim 6, further wherein said whipstock angled face has a center and said sleeve is attached to said angled face substantially in said angled face center.

11. A method of running a whipstock into a well bore comprising:

providing a substantially cylindrical mill body having at least one cutting or abrading element attached to said cylindrical mill body;

providing walls on said cylindrical mill body defining a recess therein for receiving a latch;

providing a latch moveable attached within said cylindrical body recess;

providing an actuator for remotely selectively moving said latch between a first closed position adjacent said cylindrical body and a second open position outward from said cylindrical body, and for selectively returning said latch to said first closed position;

providing a whipstock having a top and a bottom and an angled face;

providing said whipstock with a sleeve mounted along said angled face for receiving said latch;

threading said latch on said mill body into said sleeve on said whipstock;

inserting said mill body and said whipstock in said wellbore.

12. The method of claim 11, further providing the step of:

actuating said actuator to move said latch into said closed position before inserting said mill body and said whipstock in said wellbore.

13. The method of claim 11, further providing the step of:

actuating said actuator to move said latch into said open position to release said latch from said sleeve and thereby release said whipstock from said mill body.

14. The method of claim 11, further providing the step of:

actuating said actuator to move said latch into said open position and rotating said mill body relative to said whipstock to release said latch from said sleeve and thereby release said whipstock from said mill body.

* * * * *